US011585051B1

(12) United States Patent
Mizrachi et al.

(10) Patent No.: US 11,585,051 B1
(45) Date of Patent: Feb. 21, 2023

(54) REBAR PLACEMENT APPARATUSES AND METHODS

(71) Applicants: Mordechai Mizrachi, Rishon Lezion (IL); Gilad Shitrit, Rishon Lezion (IL)

(72) Inventors: Mordechai Mizrachi, Rishon Lezion (IL); Gilad Shitrit, Rishon Lezion (IL)

( * ) Notice: Subject to any disclaimer, the term of this patent is extended or adjusted under 35 U.S.C. 154(b) by 0 days.

(21) Appl. No.: 17/703,127

(22) Filed: Mar. 24, 2022

(51) Int. Cl.
*E01C 23/04* (2006.01)

(52) U.S. Cl.
CPC ..... *E01C 23/04* (2013.01)

(58) Field of Classification Search
CPC ..... E01C 23/04; E01C 23/045; E01C 11/14
See application file for complete search history.

(56) References Cited

U.S. PATENT DOCUMENTS 2,130,953 A * 9/1938 Heltzel ..... E01C 23/045 404/88
2,182,302 A * 12/1939 Nelson ..... E01C 23/045 404/88
2,295,947 A * 9/1942 Heltsel ..... E01C 23/04 404/88
3,443,495 A * 5/1969 Heltzel ..... E01C 23/04 404/100
3,566,758 A * 3/1971 Perkins ..... E01C 23/04 404/100
5,405,212 A * 4/1995 Swisher, Jr. ..... E01C 23/04 404/100
5,688,428 A * 11/1997 Maguire ..... E04G 21/185 249/91
6,092,960 A * 7/2000 McCallion ..... E01C 11/14 404/70
6,112,494 A * 9/2000 Hardy, Jr. ..... E04C 5/20 52/685
6,447,203 B1 * 9/2002 Ruiz ..... E01C 11/14 404/136
6,837,017 B2 * 1/2005 Hardy, Jr. ..... E01C 11/18 404/136
7,669,381 B1 * 3/2010 Sorkin ..... E04C 5/20 52/685
2003/0113164 A1 * 6/2003 Semler ..... E04F 21/04 404/75
2012/0247058 A1 * 10/2012 Alfonso ..... E04C 5/20 52/686
2013/0125498 A1 * 5/2013 Lowery ..... E04C 5/203 52/687
2017/0089373 A1 * 3/2017 Schulte ..... F16B 7/0493
2018/0195240 A1 * 7/2018 McDonald ..... E01C 19/504
2019/0186138 A1 * 6/2019 Shaw ..... E01C 11/14

* cited by examiner

*Primary Examiner* — Abigail A Risic
(74) *Attorney, Agent, or Firm* — Mark M. Friedman

(57) ABSTRACT

An apparatus for holding rebar rods and method for laying the same, the apparatus including an elongated member; a plurality of clasps equally spaced apart from each other and disposed on the elongated member; wherein each of the plurality of clasps is adapted to receive and hold a section of a rebar rod.

16 Claims, 6 Drawing Sheets
(2 of 6 Drawing Sheet(s) Filed in Color)

1 - 1

1 - 1

1 - 1

REBAR PLACEMENT APPARATUSES AND METHODS

FIELD OF THE INVENTION

The present invention relates to a construction and, more particularly, to an apparatus for laying rebar rods before pouring cement.

BACKGROUND OF THE INVENTION

Rebar (short for reinforcing bar), known when massed as reinforcing steel or reinforcement steel, is a steel bar or mesh of steel wires used as a tension device in reinforced concrete and reinforced masonry structures to strengthen and aid the concrete under tension. Concrete is strong under compression but has weak tensile strength. Rebar significantly increases the tensile strength of the structure. Rebar's surface is often "deformed" with ribs, lugs or indentations to promote a better bond with the concrete and reduce the risk of slippage.

Rebar cages (referred to herein as "mesh" configurations which are made up of lengthwise rods and crosswise rods) are fabricated either on or off the project site. The rebars are placed by steel fixers "rodbusters" or concrete reinforcing iron workers, with bar supports and concrete or plastic rebar spacers separating the rebar from the concrete formwork to establish concrete cover and ensure that proper embedment is achieved. The rebars in the cages are connected by spot welding, tying steel wire, sometimes using an electric rebar tier, or with mechanical connections. For tying epoxy-coated or galvanized rebars, epoxy-coated or galvanized wire is normally used, respectively.

Spot welding is generally effective for rebars with small diameters. Larger diameter rods are generally tied with steel wire. Electric rebar tier devices are not all that common and almost non-existent in third world countries. Tying rebar is one of the most labor and time intensive activities on any given worksite.

Cages that are prepared offsite present many additional challenges in both transportation of the unwieldy cages and transferal of the cages from the trucks to the correct locations in the building site.

SUMMARY OF THE INVENTION

The present invention solves many of the problems involved in rebar cages. The invention allows for rebars (referred to hereafter as 'rebar rods') to be transported in long bundles, solving the problem of wide cages. According to the present invention, the rods are laid in the desired configurations on site, in the desired location. This solves many issues relating to the transfer of rebar mesh within the site. Furthermore, rebar tying is made completely obsolete with the instant methods and apparatuses, replacing this tedious activity with an each, quick, and efficient method for laying rebar mesh.

According to the present invention there is provided a method for laying a rebar mesh, the method including: providing at least two lengthwise rebar holders and at least two crosswise rebar holders, each of the at least two lengthwise rebar holders and at least two crosswise rebar holders including: an elongated member having a receiving side, and a plurality of clasps spaced apart (e.g., at regular intervals) and attached to the receiving side; positioning the at least two lengthwise rebar holders, parallel to each other and spaced part on a support surface such that at least a portion of the plurality of clasps, of each of the at least two lengthwise rebar holders, are aligned; providing a plurality of lengthwise rebar rods and inserting a portion of the lengthwise rebar rods into the aligned clasps of the at least two lengthwise rebar holders (, wherein each of the at least two lengthwise rebar spacer has a transverse axis X which is perpendicular to parallel axes Z of the lengthwise rebar rods that are inserted in the aligned clasps); positioning the at least two crosswise rebar holders, parallel to each other and spaced apart (e.g., on the support surface) such that at least a portion of the plurality of clasps, of each of the at least two crosswise rebar holders, are aligned; (wherein the at least two crosswise rebar holders protrude/extend above the support surface at least a clasp height higher than the at least two lengthwise rebar holders; and providing a plurality of crosswise rebar rods and inserting the crosswise rebar rods into the aligned clasps of the at least two crosswise rebar holders such that the lengthwise rebar rods are disposed between the crosswise bars and the support surface.

According to further features the crosswise rebar holders are positioned on the lengthwise holders (e.g., with docking pins that lock into docking openings on the lengthwise elongated members). According to still further features the method further includes providing at least two double-sided holders; attaching the at least two double-sided holders to at least two of the crosswise rebar rods; and inserting a second layer of the lengthwise rebar rods into the at least two double-sided holders.

According to further features each of the double-sided holders includes: at least one elongated member, a plurality of receiving clasps, adapted to receive the second layer of the lengthwise rebar rods, and a plurality of support clasps adapted for attaching the doubled-sided holder to one of the crosswise rebar rods, wherein the at least one elongated member, the plurality of receiving clasps and the plurality of support clasps are coupled together.

According to further features, each of the double-sided holders includes: a double-sided elongated member having a plurality of receiving clasps disposed on a first side thereof and a plurality of supporting clasps disposed on a second side thereof.

According to still further features each of the at least two lengthwise rebar holders has a transverse axis X which is perpendicular to parallel axes Z of the lengthwise rebar rods that are inserted in the aligned clasps. According to still further features the method further includes laying at least one diagonal holder at a 45 degree angle relative to both the at least two lengthwise holders and the at least two crosswise holders; and coupling the at least two lengthwise holders and the at least two crosswise holders together at junctions where the holders overlap using fasteners attached to the at least one diagonal holder.

According to still further features the receiving clasps are oriented in a first direction that is perpendicular to a second direction in which the support clasps are oriented.

According to another embodiment there is provided an apparatus for securely holding rebar rods, including: an elongated member; a plurality of clasps equally spaced apart from each other and disposed on the elongated member; wherein each of the plurality of clasps is adapted to receive and hold a section of a rebar rod.

According to further features the elongated member has a receiving side (surface) and base/support side (surface), the plurality of clasps being disposed on the receiving side, and the support side being disposed on a plane that is adapted to be laid parallel to a support surface (deck).

According to still further features the apparatus further includes at least one supporting member disposed on the support side. According to still further features the at least one supporting member is selected from the group including: a pair of legs, a stand, an adhesive layer, a prop, a bi-prod, a tri-prod, a bolster.

According to still further features the elongated member is adapted to be attached to the support surface. According to still further features the elongated member is adapted to be attached to the support surface via coupling members selected from the group including: fasteners, screws, bolts, nails, staples and spikes attached to, or preformed on, the base side of the elongated member.

According to still further features the elongated member has a male coupling member/portion disposed on a first lengthwise end thereof and a corresponding female coupling portion/member disposed on a second, opposite, lengthwise end thereof.

According to still further features the plurality of clasps are affixed to, intimately formed with, the elongated member. According to still further features the clasps have an inverted omega shape, having an opening adapted to receive a rebar rod whereby prongs defining the opening are adapted to elastically deform to allow the rebar rod to pass through the opening. According to still further features the clasps are made from materials selected from the group including: metal, polymers, polystyrene, plastic.

According to still further features each clasp of the plurality of clasps is coupled to a second clasp, wherein the second clasp is adapted to receive a second rebar rod such that an axis A of the second rebar rod is perpendicular to an axis Z of the rebar rod.

According to still further features the apparatus further includes at least one supporting member disposed on the deck/support side of the elongated member.

BRIEF DESCRIPTION OF THE DRAWINGS

The patent or application file contains at least one drawing executed in color. Copies of the patent or patent application publication with color drawing(s) will be provided by the Office upon request and payment of the necessary fee.

Various embodiments are herein described, by way of example only, with reference to the accompanying drawings, wherein.

DESCRIPTION OF THE PREFERRED EMBODIMENTS

Figure 1A:
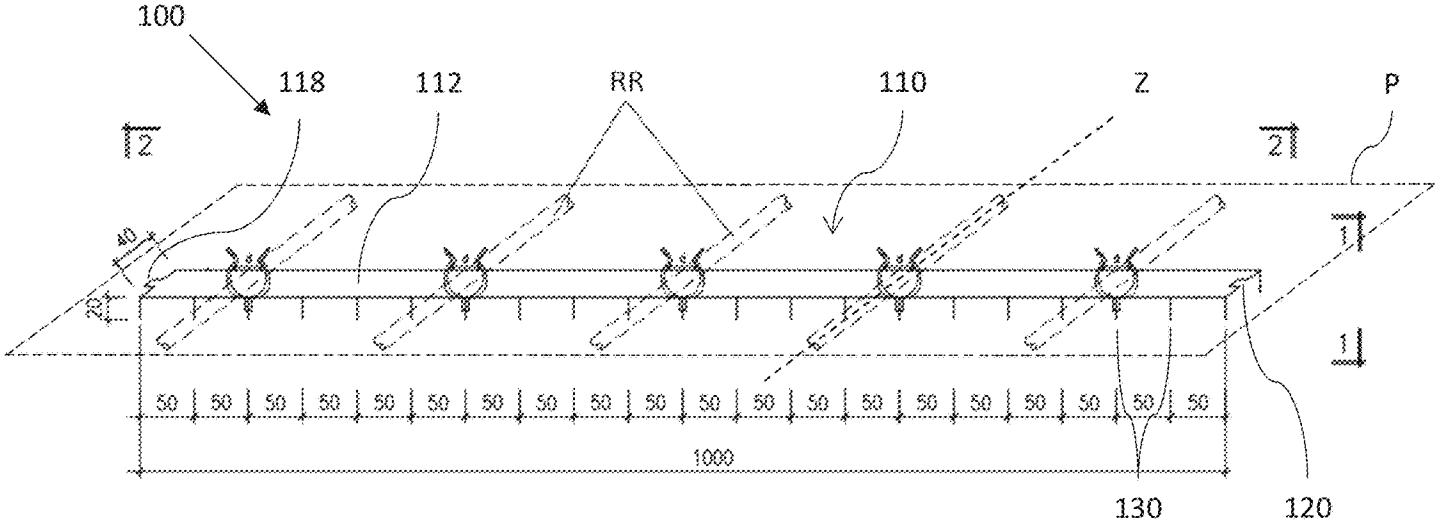
FIGS. 1A-1D are views of an example rebar holder.

The principles and operation of a method and system of apparatuses according to the present invention may be better understood with reference to the drawings and the accompanying description.

Overview

Building structures such as walls, floors, roofs, pillars, and the like are commonly made of cement reinforced with rebar rods. A common practice for making slabs of cement, whether a wall, floor, pillar etc. is to lay out a number of rebar rods in parallel to each other at more or less regular intervals (e.g., lengthwise) and then lay rebar rods widthwise or crosswise to form a mesh. In order to keep the mesh structure tightly fixed, the common practice is to bind the crisscrossing rods at various intersections.

The present method and system obviate the need for carefully laying out the rods at measured intervals and tying the rods at intersections by providing a plurality of special holders that can be arranged in a way that allows the holders to hold the rods in a mesh arrangement in a fixed and secure manner, and with much less effort, time, and manpower. The saving of time and manpower cannot be overestimated. Furthermore, especially in the US, there is greatly increased use of epoxy coated rebar which prevent corrosion of the rebars and the consequential damage to the reinforced structures. However, these rebars can only be tied together with plastic coated wire, so prevent damage to the coating. This must be done by and. The instant methods and apparatuses are ideally suited for handling such rebars, especially when using plastic or plastic-coated clasps on the holders.

It is also noteworthy to mention that the instant methods and apparatuses can save about 15% of metal that would otherwise be used. There are a number of reasons for this, but one very practical reason is that cages that are welded off-site can only have a maximum width that can be loaded onto the flatbed of a truck trailer. These dimensions are usually controlled by law (for example, in some regions the maximum width is 2.6 meters). As a result, the cages are often not of a sufficient width for the project and so two or more cages need to be laid side by side. However, since these are separate cages, they need to be placed in an overlapping manner, otherwise they will cause a weakness in the concrete. In some cases, the overlap can be half a meter, which is a pure waste of metal that results from the cages being welded together at the factory as opposed much longer rebars being laid on-site as supported by the instant methods and apparatuses.

The apparatuses, the rebar holders (hereafter also referred to interchangeably as "rebar spacers", "lengthwise holders/spacer"), each rebar holder includes an elongated member with rebar clasps fixed on the elongated member. This can be also viewed the other way around, i.e., a plurality of clasps coupled together by a common (elongated member). In some cases, there may be more than one elongated member. The clasps are structured to receive and hold a rebar rod. The rods can be held straight and parallel to the surface by two holders lined up parallel to each other (i.e., the holders are laid parallel to each other with the clasps lined up). A rod is pushed into the one holder and then into the other holder. For long rods it may be necessary to have more than two holders, to make sure that the rods do not sag between the holders. More bars or rods are set into the other clasps so that a number of rods lie parallel to each other at predefined intervals (preferably these are regular intervals). The next step is set up a similar arrangement of holders (two or more) facing the perpendicular direction. These holders (hereafter "crosswise holders", "crosswise spacers", and variations thereof) may be the same height off the surface as the lengthwise holders or they may be slightly more raised than the lengthwise holders. In embodiments, the crosswise holders have locking pins which slot into corresponding openings in the lengthwise holders. When the crosswise holders are lined up and in position, rebar rods are laid crosswise across the lengthwise rods. Now the rods form a mesh and cement can be poured.

If a greater area is needed than the length of one holder by one holder, then two or more holders can be arranged in sequence (i.e., side by side) for each direction. In this manner, the system of holders can be scaled to any size.

The same process can be duplicated for a vertical structure. However, when working against gravity, it is necessary to fixedly attach the holders to a vertical deck. This can be done in any way known in the art.

In some cases, two or more layers of rebar mesh are required. In these cases, double-sided holders are used to build a second layer. The double-sided holders have clasps on both sides. The clasps may either be in the same direction or in opposite directions. The double-sided holders are clicked onto the bottom layer of rebar rods for positioning and the new layer of rebar rods are inserted into the still-free clasps. This is done in both the lengthwise and crosswise directions.

Various terms used herein have more than one meaning or use in general and even in the specific field of art. Furthermore, different terms are used in different regions to refer to certain components and/or processes and in some cases a single term is used in different regions to mean different things. Accordingly, various terms are explained hereafter with references to the accompanying figures in order to provide explanations as to how the authors intend the terms to be interpreted. Terms and phrases that are not specifically discussed should be understood according to their common meaning in the field of art and/or based on the context and/or accompanying Figures.

Rebar Holder

Figure 1B:
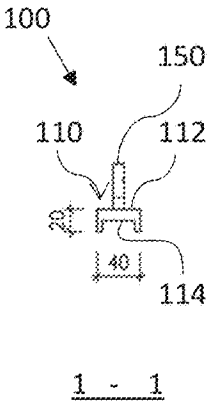

FIG. 1A illustrates an example rebar holder 100. The rebar holder includes an elongated member 110 and a plurality of clasps 150. FIG. 1B is a perspective view 1-1 of the rebar holder 100.

Elongated Member

As referred to herein, an elongated member is a length of plastic, metal, polymer or any combination thereof that is populated by a plurality of clasps 150. In the illustrated example embodiment of FIG. 1A, the elongated member 110 is rectangular in shape with a width at least as wide as a clasp member and a thickness (and strength of material) sufficient to hold the weight of several rebar rods. In the depicted example embodiment, the holder is configured to hold five rods. The rebar rods RR are shown in broken lines merely for the purpose of illustration. The length of the elongated member can vary based on several factors. Some of the factors include but are not limited to: the type of material from which the member is made, the diameter of the rebar rods that will be attached to the member, the desired spacing between parallel rods, where/how the member is intended to be used.

The elongated member 110 has a receiving side or surface 112 and base side or surface 114. The base surface is also referred to herein as the support surface (i.e., the surface that abuts the supporting member or members or structure, such as a wall or floor). In some regions, the support surface is referred to as the deck, as such, the support surface may also be referred to as the deck surface. The support side of the elongated member is disposed on a plane P that is adapted, when in use, to be [laid] parallel to a support surface (deck).

In some embodiments, the elongated member further includes at least one supporting member disposed on the support side. For example, the supporting member may be a pair of legs, or multiple pairs of legs (like a centipede), a stand, a prop, a bolster, a bi-prod, a tri-prod and/or an adhesive layer. In the example embodiment of FIG. 1A the support members are multiple pairs of legs 130.

Figure 8B:
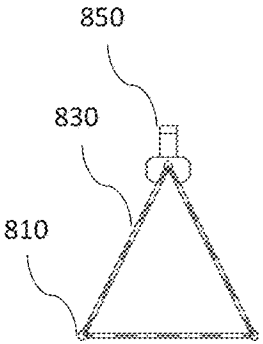
FIGS. 8A and 8B are view of a bolster holder.
Figure 8A:
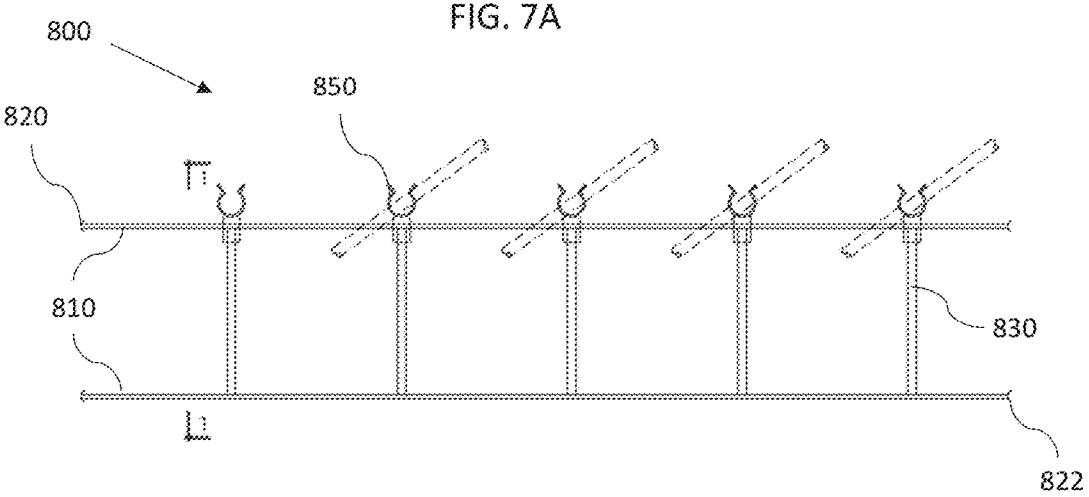

In some cases, it is necessary to raise or bolster the member (and hence the rebar rods) away from the surface/deck (see for e.g., FIGS. 8A-B). The one or more of the aforementioned support members (or other support members not specifically disclosed herein but would be known or devised by those skilled in the art in view of the current disclosure) can provide that function.

In some instances, the elongated member needs to be attached to a wall (or floor or other deck/surface) directly. In some instances, an adhesive layer may serve to facilitate this function. In other cases, the elongated member may simply be attached to the support surface in any one of a number of ways. For example, the elongated member may be attached by fasteners, screws, bolts, nails, protruding rebar/wire, and/or staples to the deck/support surface.

In some cases, an intermediate item or items may be placed between the elongated member and the deck, for example, one or more lengths of plastic or fashioned metal rods. The elongated member may, for example, be coupled to the intermediate item(s) and then nailed into a wall/deck, or otherwise affixed thereto.

In some embodiments, spikes may be attached to, or preformed on, the base/deck/support side of the elongated member. These spikes facilitate affixing the elongated member to the support surface without the need for additional fasteners (or in addition to other fasteners).

Figure 2:
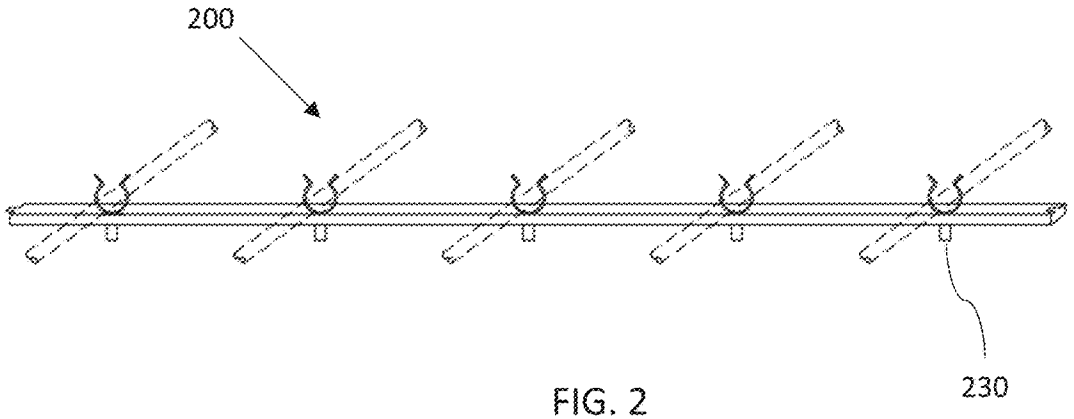
FIG. 2 is a second configuration of a rebar holder.

FIG. 2 depicts another configuration of the rebar holder. Rebar holder/spacer 200 has all the features and characteristics of rebar holder 100, except for the type of support member. In embodiments, elongated members may be laid both lengthwise and crosswise. In fact, such a configuration may often be needed in order to achieve a mesh configuration of the rods. To this end, in some embodiments, such as the example embodiment depicted in FIG. 2, locking or docking pins 230 may be coupled or formed on the support side of the elongated member. It can be stated that a set of lengthwise rebar holders, such as rebar holders 100 (hereafter also referred to as "lengthwise rebar holders" having "lengthwise elongated members" and/or any characteristics which can now be prefixed with the term "lengthwise") may be populated with legs (support members) 130 on the support sides of the lengthwise elongated members and a set of crosswise rebar holders such as rebar holders 200 (hereafter also referred to as "crosswise rebar holders" having "crosswise elongated members" and/or any characteristics which can now be prefixed with the term "crosswise") may be populated with docking pins 230 on the support sides of the crosswise elongated members. The lengthwise elongated members have docking apertures (not shown) on their receiving sides for the docking pins to fit into. Rebar rods are first placed in the lengthwise clasps and then the crosswise holders 200 are arranged on top of the lengthwise holders and the rebar rods are laid in the clasps. The resulting configuration of the rebars rods is a mesh, but without the rods [necessarily] touching each other.

It is made clear that the terms "lengthwise" and "crosswise" are used herein merely to distinguish direction of arrangement of the one rebar holder relative to the other, but not intending to commit one type of holder to be laid in a particular direction and the other type to be laid in another direction. The lengthwise and crosswise holders are laid our perpendicular to each other.

In some example embodiments, one or more diagonal rebar rods may be laid across the mesh to ensure that the square (or rectangular), mesh formation is securely held together at right-angles.

In some cases, it is necessary to lay more than one elongated member in series. To ensure regular intervals between the clasps, and facilitate the easy, fast, and regular laying of rebar rods, in some example embodiments, the elongated members have coupling arrangements on each end of the member. In the example embodiment of FIG. 1A, the elongated member 110 has a male coupling portion 120 disposed on a first lengthwise end thereof and a corresponding female coupling portion 122 disposed on a second, opposite, lengthwise end thereof. In this manner, the elongated members can be coupled together to ensure the tight regular formation required, regardless of the dimensions of the structure supported by the arrangement of rebar rods.

In some embodiments, the elongated members may be made of a flexible polymer (such as rubber or silicone) that can be manipulated to conform to a non-linear surface (e.g., such as a corner or curve) or even to form a standalone shape (such as a circle, oval, square, rectangle, and the like), e.g., for supporting pillars, posts, pylons, and the like.

The receiving side 112 is termed such as this is the side that receives the rebar rods, or, more precisely, the side or surface on which the clasps 150 that receive the rods are disposed. The elongated member is prepared with a plurality of clasps disposed on the receiving side. The clasps are disposed at regular intervals along the member. In embodiments, the clasps are arranged such that when two elongated members are coupled together, the intervals between the clasps remain regular and uninterrupted.

Figure 1D:
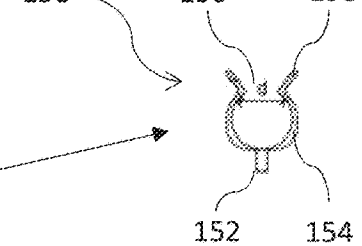
Figure 1C:
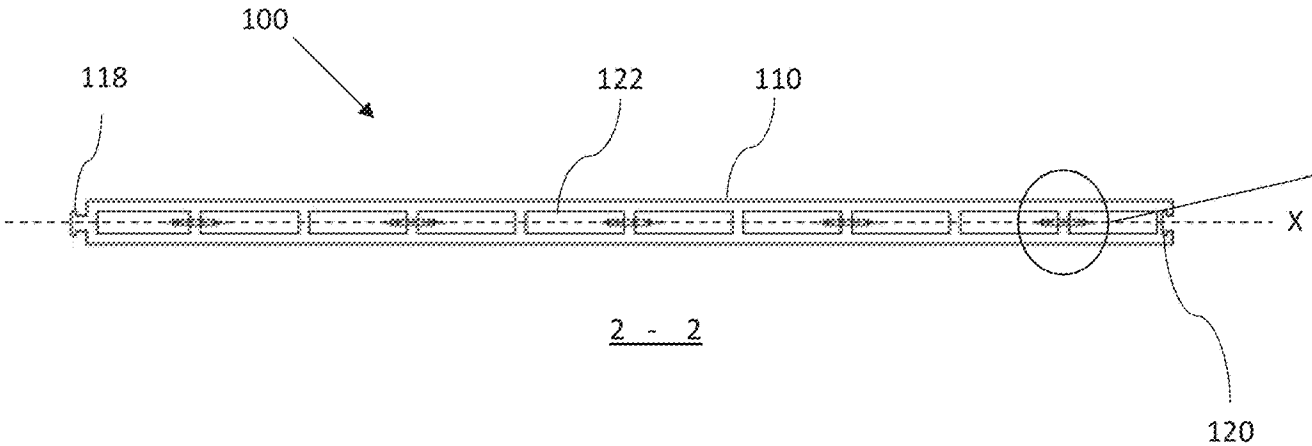

FIG. 1C is a top-down view 2-2 of the rebar rod 100. In order for the elongated members to be light and cost efficient, in some embodiments, there are opening (areas devoid of material) or spaces in the elongated member. For example, spaces 118 are disposed in elongated member 110.

In some embodiments, there may be more than one elongated member for each spacer. For example, some 'complex' spacers/holders may include a plurality of clasps connected together by bars (elongated members) running along two opposing sides of the clasps (see FIG. 3B for an example).

Clasps

FIG. 1D is a facing view of a clasp 150. The diameter d of the opening of the clasp is equal to, or just smaller than, the diameter of the rebar rod RR that is intended to be inserted into the clasp.

The plurality of clasps may be made of the same material as the elongated member or a difference material. In embodiments, the clasps are affixed to the elongated member. Any fastener or manner of fastening may be used to couple or affix the clasp to the elongated member. For example, the clasps may each be affixed to the elongated member by one or more of the following: a screw, a nail, a staple, welding, adhesive, heating, screwing the clasp onto a preformed external or internal thread, a snap-fit fixture, and/or indeed any type of fastener. For example, the clasp 150 depicted in FIG. 1D has a coupling piece 152 by which the clasp can be inserted in a corresponding opening (not shown) in the elongated member 110. For example, clasp 150 with coupling piece 152 may couple to the elongated member in "snap-fit" or similar coupling arrangement. Furthermore, there may be a plurality of spaced apart openings on the elongated member into which clasps can be inserted at regular or irregular intervals, as decided by the user. In this manner, the holders can be customized for use, by the user selecting the interval size between clasps according to the needs of the project or work at hand. The elongated members and clasps can even be sold separately as 'coupled together' as needed.

Alternatively, the clasps may be intimately formed with elongated member. For example, both the elongated member (or in some embodiments elongated members) and the clasps may be formed as a single member using injection molding, 3D printing, or thermoforming etc. Preformed or pre-coupled holders can be provided in various configurations, such as in standard or common lengths, intervals between clasps and/or types of support members.

Each clasp is designed and structured for receiving and holding part of a rebar rod. At least two clasps, spaced apart (i.e., on separate holders), are needed to hold a rebar rod/bar straight. In some embodiments, the clasp body 154 has an inverted omega shape, having an opening 156 adapted to receive a rebar rod whereby prongs 158, which define the opening between them, are adapted to elastically deform to allow the rebar rod to pass through the opening. In other embodiments, the clasps 150 are not omega shaped but rather simply include an inlet that is adapted to hold therein a portion of a rebar rod. The clasps are made from materials selected from the group including: metal, polymers, polystyrene, plastic.

Double-Sided Spacers

Figure 3A:
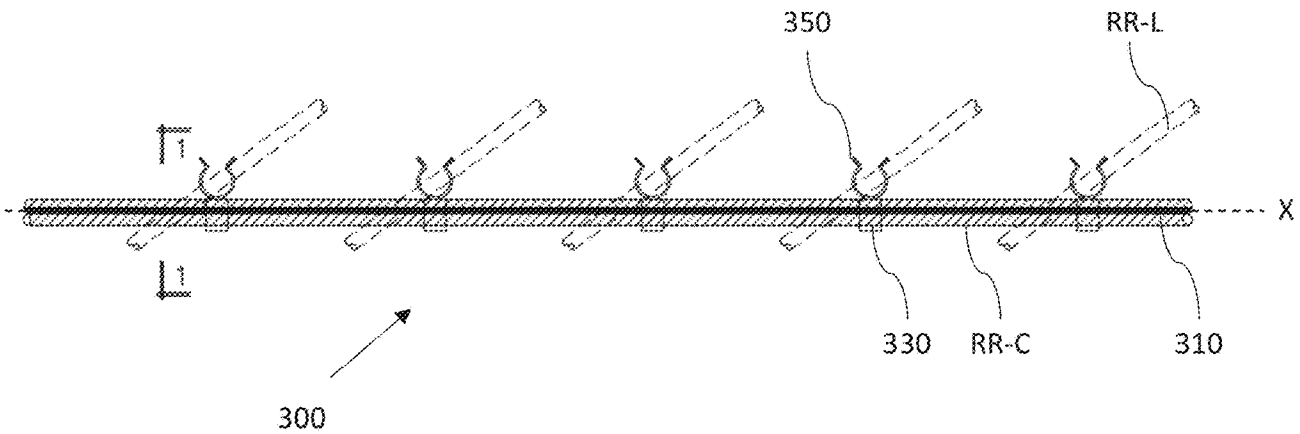
FIGS. 3A and 3B are view of a double-sided holder/spacer.
Figure 3B:
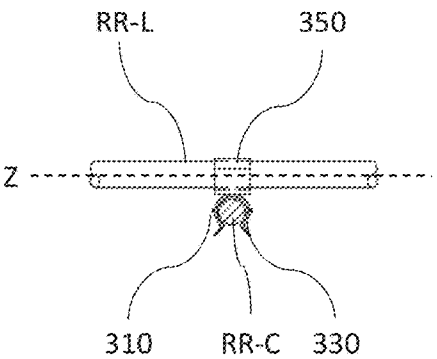

FIG. 3A illustrates a facing view of a double-sided holder/spacer 300. FIG. 3B is a perspective view 1-1 of FIG. 3A. Holder 300 includes a plurality of clasps 150 coupled together by two elongated members 310 on two opposing sides of the clasps. In example embodiments, the holder 300 includes only one elongated member 310. Merely for the sake of clarity, holder 300 is being designated a lengthwise double-sided rebar holder 300, or simple a lengthwise holder 300.

Double-sided holders can be used on lengthwise rebar rods to support crosswise rebar rods to complete the mesh configuration. Alternatively, or additionally, the double-sided holders can be used to form one or more additional layers of rebar rods onto of an existing mesh. In this way, multiple mesh layers can be arranged, one on top of the other.

The holder 300 can be described in the following two, different, ways. One way of describing the holder 300 is having a plurality of clasps 350 on a receiving side and for each receiving clasp 350 there is a supporting member 330, hereafter also referred to as a supporting clasp 330. In some embodiments, the supporting clasps may not be aligned with, or connected to, the receiving clasps 350. There may be more or less supporting clasps than receiving clasps. The supporting clasps are adapted to attach to a crosswise rebar rod RR-C (which itself is coupled to at least two crosswise rebar holders, e.g., crosswise rebar holder 200). Each of the receiving clasps 350 is adapted to receive a lengthwise rebar rod RR-L.

Note that the axis Z on which the lengthwise rebar rod RR-L lies is perpendicular to the axis X on which the lengthwise elongated member or members lie.

Another way of describing the double-sided holder 300 is to say that there is a plurality of double-sided clasps coupled together, e.g., by an elongated member. Each double-sided clasp is made up of a receiving body/clasp and a supporting body/clasp. When viewing the receiving body/clasp from the direction of in which a rebar rod would lie, it can be said that the body has a top, open end, a bottom, closed end and two sidewalls. Similarly, but with a horizontally flipped orientation (180 degrees), as well as a vertically rotated (90 degrees) orientation. The top, lengthwise, or receiving clasp 350, may be coupled directly to the bottom, crosswise, or supporting clasp in any number of manners. For example, the clasp bodies may be attached together (e.g., by adhesive, heat, screw, nail, snap-fit fastener and/or any other fastener or coupling arrangement), may be intimately formed together (e.g., injection molding, 3D printing, thermoforming etc.), and/or may be coupled (or intimately formed) on either side of a flat elongated member. In the instantly depicted embodiment shown in FIGS. 3A and 3B, the clasp bodies are couple or formed together and two elongated members are coupled to the crosswise/support clasps 330.

Figure 4A:
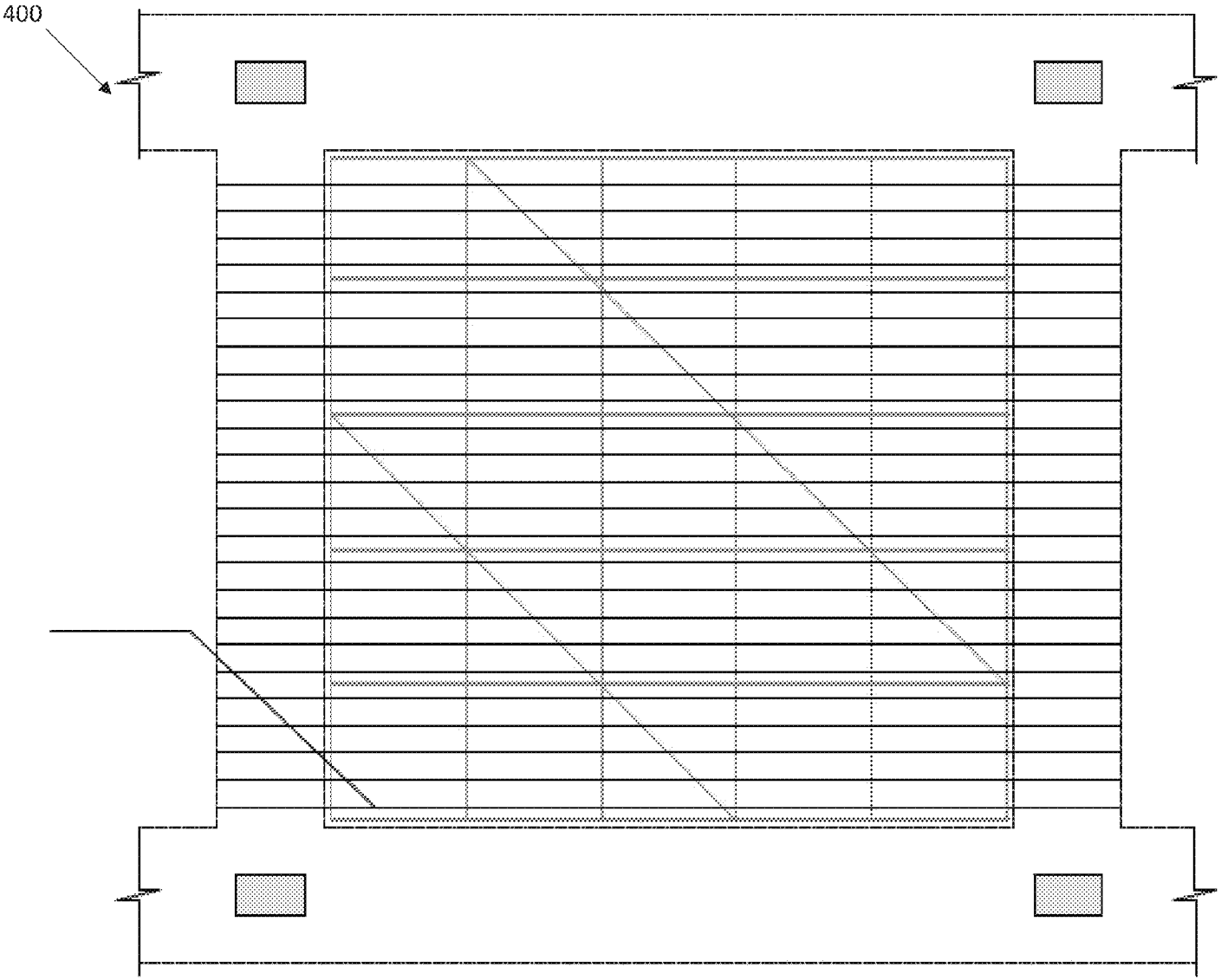
FIG. 4A is a schematic drawing of an example of a partially formed mesh arrangement of rebar holders and rods for a segment of a building project.

FIG. 4A is a schematic drawing of an example of a partially formed mesh arrangement of rebar holders and rods for a segment of a building project. The drawing depicts the stage of the task where the lengthwise holders and rebar rods have been laid down as well as the crosswise holders.

Figure 4B:
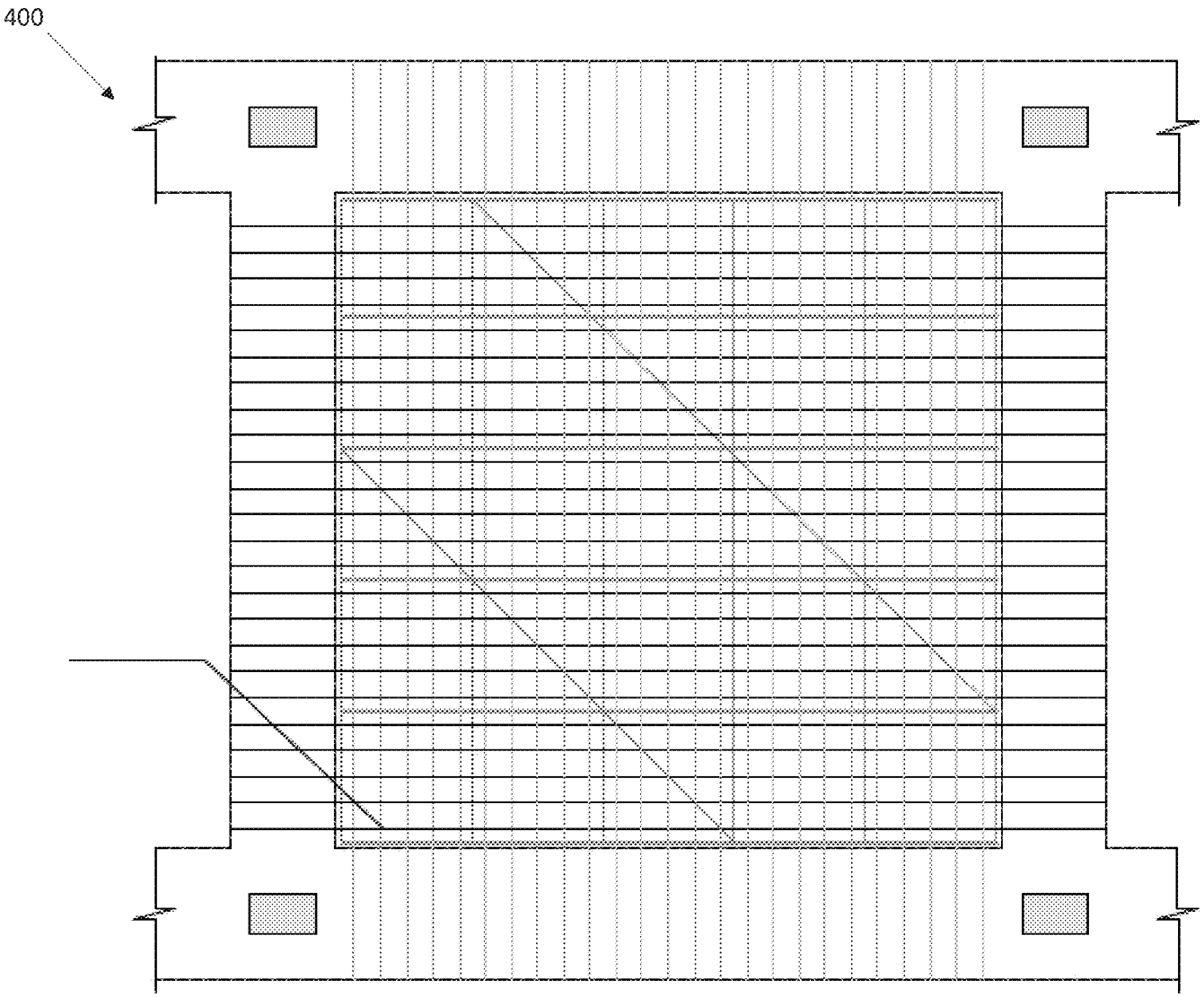
FIG. 4B is a schematic drawing of an example of a completed mesh arrangement of rebar holders and rods for a segment of a building project.

FIG. 4B is a schematic drawing of an example of a completed mesh arrangement of rebar holders and rods for a segment of a building project. The configuration can be provided in various ways. Two methods for providing a mesh configuration are discussed hereafter followed to a third method relating to a mesh with at least one additional layer of rebar rods.

Method 1—Lengthwise Holders and Crosswise Holders

Figure 5:
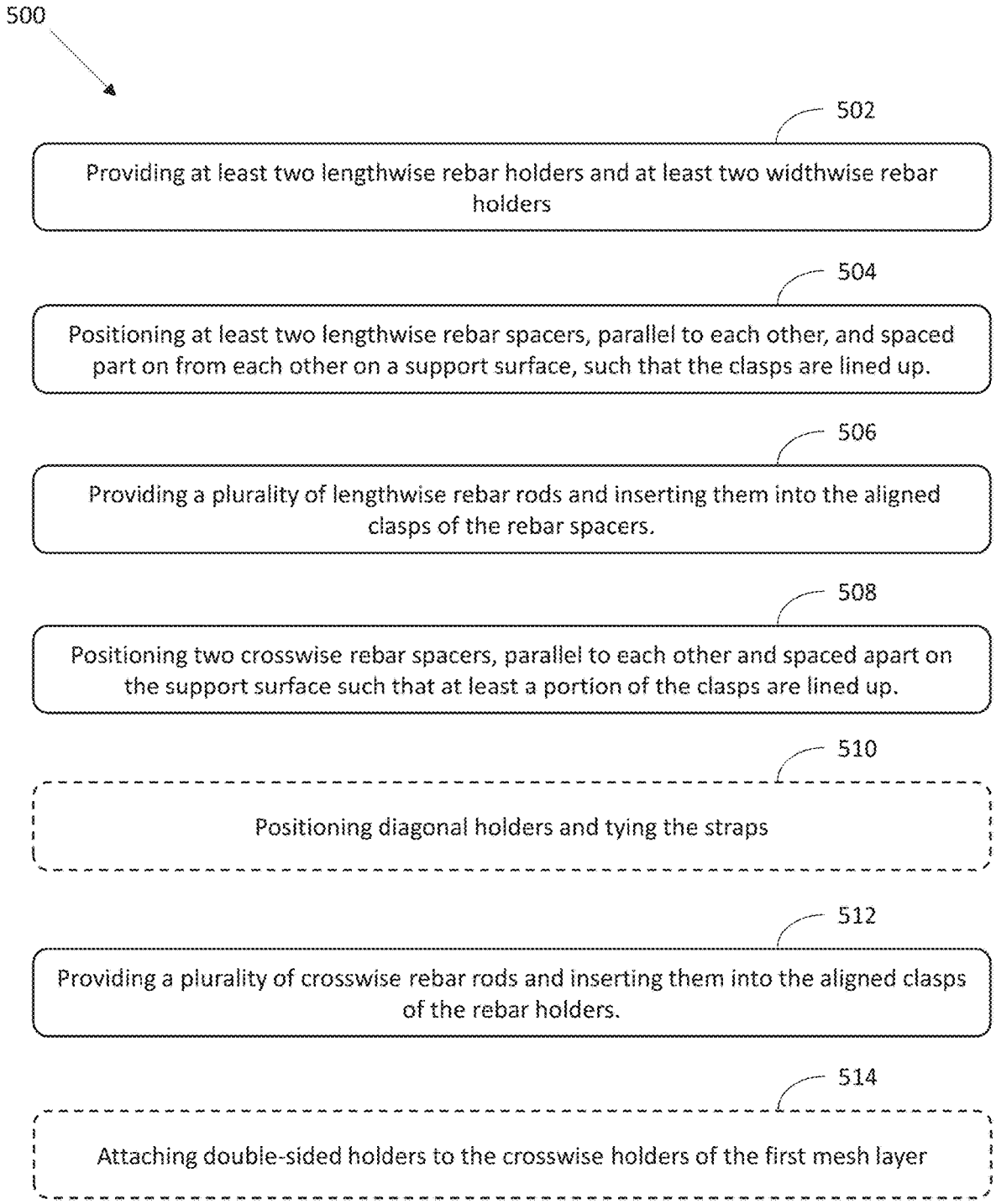
FIG. 5 is a flow chart of a method 500 of providing a rebar rod mesh according to some embodiments.

FIG. 5 depicts a flow chart of a method 500 of providing a rebar rod mesh according to some embodiments. The method 500 for laying a rebar mesh starts at step 502 and entails providing at least two lengthwise rebar spacers/holders and at least two crosswise rebar spacers/holder. For example, the lengthwise rebar holders may be the same as, similar to, or a variation of the lengthwise rebar holders 100; and the crosswise rebar holders may be the same as, similar to, or a variation of the crosswise rebar holders 200.

Each of the lengthwise and crosswise rebar holders include at least an elongated member having a receiving side, and a plurality of clasps spaced apart at regular intervals and attached to the receiving side.

At step 504 the at least two lengthwise rebar holders are positioned parallel to each other and spaced part from each other on a support surface. The holders are placed such that at least a portion of the plurality of clasps, of each of the at least two lengthwise rebar holders, are aligned with each other.

In step 506 a plurality of lengthwise rebar rods is provided and inserted into the aligned clasps of the at least two lengthwise rebar holders. Each of lengthwise rebar spacer has a transverse axis X which is perpendicular to parallel axes Z of the lengthwise rebar rods that are inserted into the clasps.

At step 508, at least two crosswise rebar holders are positioned parallel to each other and spaced apart from each other on the support surface such that at least a portion of the plurality of clasps, of each of the at least two crosswise rebar holders, are aligned or lined up.

The crosswise rebar holders (e.g., holders 200) are adapted such that the crosswise clasps are at least a clasp height higher than the lengthwise clasps of the lengthwise rebar holders.

This arrangement can be achieved in various ways. One example embodiment entails the crosswise holders having bolsters/support members that raise the elongated member and/or clasps higher than the clasps of the lengthwise holders.

In order to illustrate this option, a detailed example of a rebar holder (such as a lengthwise holder) is provided. Thereafter the measurements of an example crosswise rebar holder according to the option will be detailed. The detailed example provides measurements for most of the parameters of the holder and includes some optional variations. These measurements are also depicted in an exemplary manner in FIG. 1A. The example is not intended to limit the scope of the invention in any way, but merely to provide one detailed example for implementing the invention.

In the example of FIG. 1A all the measurements are given millimeters (mm). The length of the elongated member is 1000 mm (1 meter) and the width of the member is 40 mm. The height of the legs, including the thickness of the elongated member, is 20 mm. The [pairs of] legs 130 are disposed at 50 mm intervals. The clasps are positioned at 200 mm (20 centimeter [cm]) intervals. According to other example options, the intervals can be 10, 15, or 25 cm intervals, or indeed any desired intervals. The elongated member can likewise, optionally, be 2 or 3 meters in length, or indeed any desired length.

Holders of different (possibly standard, or standardized) lengths can be provided, e.g., in different colors or including relevant markings to easily distinguish between them. Marking the holders of different length in easily distinguishable manners allows workers to effortlessly and correctly choose the holder of the desired length.

Similarly, there may be clasps of different diameters (or adapted to receive rebar rods of different ranges of diameters). For example, the clasps may be adapted to receive rods of diameters including 12, 14, 16, 18, 20, 22, 25, and/or 32 millimeters. Clasps may be provided to receive rods of only one specific diameter, or of a range of diameters. The clasps may be color coded or have other indicative and/or distinctive markings for easily selecting the appropriate clasps for the task at hand. As mentioned elsewhere, the clasps and elongated members may be sold/provided separately, with the users choosing preferred elongated members and required clasps for each task on an individual basis and then connecting them together in the desired configuration (e.g., the number of clasps per member and the length of interval per clasp. In some cases, it may even be necessary to have inconsistent intervals, as the task may require.

Referring back to the method of arranging the mesh of rebar rods discussed above, after laying down the lengthwise rebar rods RR-L, at step 506, the next step, step 508, is to position crosswise holders parallel to the lengthwise rebar rods and perpendicular to the lengthwise holders. In FIG. 4A the lengthwise holders are depicted in green and the lengthwise rebar rods are depicted in black. The crosswise holders are depicted in blue.

In order for the clasps of the crosswise holders to be higher off the surface than the lengthwise clasps, in one example embodiment, the crosswise holders may be similar to holders 100 (which, until now have been referred to as 'lengthwise holders' for clarity but are not actually intended to be limited to being used in this manner), but with the modification whereby the legs of the crosswise holders are longer than the legs of the lengthwise holders. For example, the legs, together with the thickness of the elongated member, may be 60 mm high. In this manner, the supporting members of both the lengthwise and crosswise holders are legs, only that the legs of the crosswise holders are longer.

In another example embodiment, the crosswise holders are the same as, or similar to, holders 200 depicted in FIG. 2. According to this embodiment, the crosswise holders, in step 508, are slotted onto the lengthwise elongated members by inserting the docking pins 230 into corresponding apertures (not shown) in the lengthwise elongated members. According to this embodiment, the lengthwise and crosswise rebar holders are locked together in their own weave/mesh configuration. This embodiment may provide a more rigid, secure, and precise mesh configuration. FIG. 4A depicts the incomplete assembly of the rebar mesh at the current stage of process 500.

For either, both or any other example embodiments, there is provided an optional step 510, which entails laying down a diagonal holder diagonally across the lengthwise and crosswise holders in the assembly 400. One or more diagonal holders may be laid diagonally across the mesh structure to further ensure the species spacing and alignment of the rods.

Figure 6:
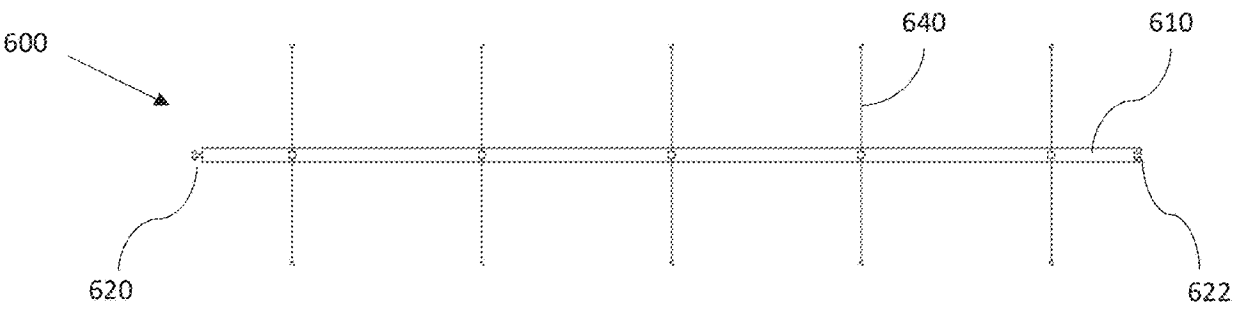
FIG. 6 is an example embodiment of a diagonal holder.

FIG. 6 depicts an example embodiment of a diagonal holder 600. Holder 600 includes an elongated body 610. The elongated body includes male 620 and female 622 coupling members on the opposing longitudinal ends of the body. Further, a number of fasteners, for example straps 640 are positioned or located along the elongated body of the diagonal holder. The straps may be of any type of flexible material. In one example embodiment, the straps 640 are zip ties. The straps may be attached to, or fixed on, the body at abutments 642 which are, for example, located at regular intervals on the elongated body. At optional step 510, the diagonal holder, depicted in pink, is laid across the junctions where the lengthwise and crosswise holders overlap. The holder is positioned so that the straps are located at the junctions. The straps are used to tie the holders together where they overlap. In some embodiments or variations, the diagonal holders are placed over the crosswise holders (i.e., on top of the crosswise holders, if the surface is considered the bottom) and in other embodiments or variations, the diagonal holder is place between the lengthwise holders and the surface (i.e., underneath the lengthwise holders, if the surface is considered the bottom).

In step 512 of process 500, a plurality of crosswise rebar rods is provided and inserting into the aligned clasps of the crosswise rebar holders. FIG. 4B depicts the completed assembly of the lengthwise and crosswise rebar rods. In addition to that which was depicted in FIG. 4A, in FIG. 4B, the crosswise rebar rods RR-C are depicted in gray.

Method 2—Lengthwise Holders and Double-Sided Holders

Another method for assembling a mesh (crisscross configuration) of holders and rebar rods is as follows. Steps 502-506 are the same as Method 1. In Step 508, instead of using crosswise holders, substitute instead double-sided holders. The support clasps of the double-sided holders are attached to some (or all) of the lengthwise rebar rods. At step 512, the crosswise rebar rods RR-C are placed in the receiving clasps of the double-sided holders.

Method 3—Lengthwise Holders and Crosswise Holders Plus at Least One Layer from Double-Sided Holders.

In method 3, the first mesh layer is arranged as detailed in Method 1, according to any of the various options and embodiments. In addition, at optional step 514, double-sided holders are attached to the crosswise holders of the first mesh layer. Rebar rods are then inserted into the receiving clasps. Additional layers can be further added in this manner.

Figure 7B:
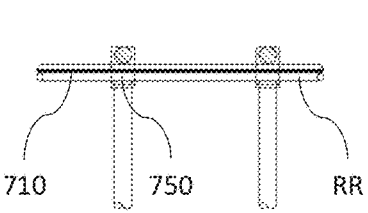
FIGS. 7A and 7B are views of a corner holder.
Figure 7A:
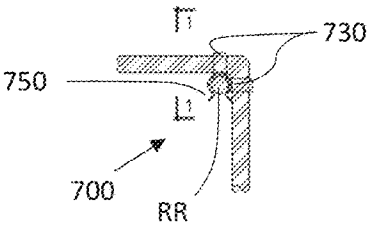

FIG. 7A is of a corner holder 700. FIG. 7B is a perspective view 1-1 of FIG. 7A. The corner holder includes an elongated member, here depicted as bar 710. Bar 710 couples receiving clasps 750 in a row. Two support clasps 730 are coupled to the receiving clasp, at right angles to each other. The corner holder is adapted to be attached to bent rebar rods that have a vertical portion and horizontal portion. It is made clear that the terms vertical and horizontal are merely used to indicate relative positions of the portions, as opposed to any objective direction in space. The two support clasps 730 each couple to one of the vertical and horizontal portions of the bent rebar.

FIGS. 8A and 8B depict an example bolster holder 800. FIG. 8B is a perspective view 1-1 of FIG. 8A. Bolster holder 800 has a plurality of triangular support members 830 with clasps 850 disposed at the apex of the triangular bolster. Elongated members, bars 810, couple the triangular bolsters together. Bars 810 have male 820 and female 822 coupling arrangements on opposite ends of each bar 810.

While the invention has been described with respect to a limited number of embodiments, it will be appreciated that many variations, modifications and other applications of the invention may be made. Therefore, the claimed invention as recited in the claims that follow is not limited to the embodiments described herein.

What is claimed is:

1. A method for laying a rebar mesh, the method comprising:

(a) providing at least two lengthwise rebar holders and at least two crosswise rebar holders, each of said at least two lengthwise rebar holders and at least two crosswise rebar holders including:

(i) an elongated member having a receiving side, and (ii) a plurality of clasps spaced apart at intervals on said receiving side;

(b) positioning said at least two lengthwise rebar holders, parallel to each other and spaced part on a support surface such that at least a portion of said plurality of clasps, of each of said at least two lengthwise rebar holders, are aligned;

(c) providing a plurality of lengthwise rebar rods and inserting said lengthwise rebar rods into said aligned clasps of said at least two lengthwise rebar holders, such that said lengthwise rebar rods lie perpendicular to said lengthwise rebar holders;

(d) positioning said at least two crosswise rebar holders perpendicular to said lengthwise holders, said crosswise rebar holders parallel to each other and spaced apart such that at least a portion of said plurality of clasps, of each of said at least two crosswise rebar holders, are aligned;

(e) providing a plurality of crosswise rebar rods and inserting said crosswise rebar rods into said aligned clasps of said at least two crosswise rebar holders such that said crosswise rebar rods lie perpendicular to said crosswise rebar holders and to said lengthwise rebar rods which are disposed between said crosswise bars and said support surface; and (f) pouring cement over the rebar mesh and holders.

2. The method of claim 1, wherein said crosswise rebar holders are positioned on said lengthwise holders.

3. The method of claim 1, further comprising:

providing at least two double-sided holders;

attaching said at least two double-sided holders to at least two of said crosswise rebar rods; and inserting a second layer of said lengthwise rebar rods into said at least two double-sided holders.

4. The method of claim 3, wherein each of said double-sided holders includes:

at least one elongated member, a plurality of receiving clasps, adapted to receive said second layer of said lengthwise rebar rods, and a plurality of support clasps adapted for attaching said doubled-sided holder to one of said crosswise rebar rods, wherein said at least one elongated member, said plurality of receiving clasps and said plurality of support clasps are coupled together.

5. The method of claim 1, wherein each of said double-sided holders includes: a double-sided elongated member having a plurality of receiving clasps disposed on a first side thereof and a plurality of supporting clasps disposed on a second side thereof.

6. The method of claim 1, wherein each of said at least two lengthwise rebar holders has a transverse axis X which is perpendicular to parallel axes Z of said lengthwise rebar rods that are inserted in said aligned clasps.

7. The method of claim 1, further comprising:

laying at least one diagonal holder at a 45 degree angle relative to both said at least two lengthwise holders and said at least two crosswise holders; and coupling said at least two lengthwise holders and said at least two crosswise holders together at junctions where the holders overlap using fasteners attached to said at least one diagonal holder.

8. An apparatus for securely holding rebar rods, comprising:

an elongated member;

a plurality of clasps equally spaced apart from each other and disposed on said elongated member each of said plurality of clasps adapted to receive and hold a section of a respective rebar rod, wherein said elongated member has a receiving side and support side, said plurality of clasps being disposed on said receiving side, and said support side being disposed on a plane that is adapted to be laid parallel to a support surface; and wherein said elongated member and said plurality of clasps are adapted to have cement poured thereon.

9. The apparatus of claim 8, further comprising at least one supporting member disposed on said support side.

10. The apparatus of claim 9, wherein said at least one supporting member is selected from the group including: a pair of legs, a stand, an adhesive layer, a prop, a bi-prod, a tri-prod, a bolster.

11. The apparatus of claim 8, wherein said elongated member is adapted to be attached to said support surface.

12. The apparatus of claim 8, wherein said elongated member is adapted to be attached to said support surface via coupling members selected from the group including: fasteners, screws, bolts, nails, staples and spikes attached to, or preformed on, said base side of said elongated member.

13. An apparatus for securely holding rebar rods, comprising:

an elongated member;

a plurality of clasps equally spaced apart from each other and disposed on said elongated member each of said plurality of clasps adapted to receive and hold a section of a respective rebar rod, wherein said elongated member has a male coupling member disposed on a first lengthwise end thereof and a corresponding female coupling member disposed on a second, opposite, lengthwise end thereof; and wherein said elongated member and said plurality of clasps are adapted to have cement poured thereon.

14. The apparatus of claim 8, wherein said plurality of clasps are affixed to said elongated member or intimately formed with said elongated member.

15. The apparatus of claim 8, wherein said clasps have an inverted omega shape, having an opening adapted to receive a rebar rod whereby prongs defining said opening are adapted to elastically deform to allow said rebar rod to pass through said opening.

16. The apparatus of claim 15, further comprising a second elongated member including a plurality of claps equally spaced apart from each other and disposed on said second elongated member, each of said plurality of clasps adapted to receive and hold a section of said rebar rod; and wherein each clasp of said plurality of clasps is coupled to a second clasp, wherein said second clasp is adapted to receive a second rebar rod such that an axis Z of said second rebar rod is perpendicular to an axis X of said rebar rod.

* * * * *